United States Patent [19]

Magee

[11] Patent Number: 5,024,408

[45] Date of Patent: Jun. 18, 1991

[54] ATHLETIC SHOE HOLDER

[76] Inventor: Maynard Magee, 63195 O. B. Riley Rd., Bend, Oreg. 97701

[21] Appl. No.: 516,817

[22] Filed: Apr. 30, 1990

[51] Int. Cl.[5] ..... A47G 29/00

[52] U.S. Cl. ..... 248/206.5; 211/34; 248/316.4

[58] Field of Search ..... 211/34, 35, 37, 43; 248/206.5, 316.4

[56] References Cited

U.S. PATENT DOCUMENTS

| | | | |
|---|---|---|---|
| 2,673,650 | 3/1954 | Olson | 211/35 |
| 3,256,616 | 6/1966 | McGoldrick . | |
| 3,316,659 | 5/1967 | Lauck . | |
| 3,344,532 | 10/1967 | Bigler . | |
| 3,408,771 | 11/1968 | Garrett et al. | 248/206.5 X |
| 3,724,095 | 4/1973 | Laue et al. . | |
| 3,870,153 | 3/1975 | Allsop et al. | 211/37 |
| 4,109,397 | 8/1978 | Daily . | |
| 4,677,760 | 7/1987 | St. Louis . | |
| 4,702,016 | 10/1987 | Grigsby et al. . | |
| 4,813,641 | 3/1989 | Wilson . | |

FOREIGN PATENT DOCUMENTS

| | | | |
|---|---|---|---|
| 736565 | 11/1932 | France | 248/316.4 |
| 4405 | of 1907 | United Kingdom | 211/37 |

*Primary Examiner*—David L. Talbott

*Attorney, Agent, or Firm*—Karlquist, Sparkman, Campbell, Leigh & Whinston

[57] ABSTRACT

An apparatus for holding shoes includes a first member and a second member slidably engaged with the first member. A mechanism is provided in the first member for selectively engaging and restraining the second member within the first member. The first and second member are extended apart, placed about the sole of a shoe, and compressed together to clamp the first and second member to the sole of the shoe. Magnets within the first member hold the apparatus and the shoe to any ferromagnetic surface. A lever arm is provided on the second member to disengage the restraining mechanism to allow rapid removal of the apparatus from the shoe.

5 Claims, 2 Drawing Sheets

ATHLETIC SHOE HOLDER

TECHNICAL FIELD

The present invention relates to an apparatus for holding shoes for storage, display, and drying. Specifically, the holder consists of a clamp which can clamp about the sole of a shoe and, with internal magnets, hold the shoe on any ferromagnetic surface.

BACKGROUND ART

Athletic shoes have evolved into highly specialized shoes for each sport and usage. It is not uncommon for a person to own a different pair of athletic shoes for each sport in which they participate such as tennis, jogging, hiking, or the like. As the specialization of the shoes has increased, so has the cost. Originally, athletic shoes were considered disposable. Now, they are repairable. Athletic shoes are now cared for as much, if not more, than dress shoes.

Because of the increase in the number of pairs of athletic shoes that a person owns, storage has become a problem, and a need exists for unique storage for these shoes which allows maximum airflow to dry the shoes of perspiration and other moisture. Athletic shoes also become soiled or wet from usage in inclement weather. It is often necessary to wash the shoes to eliminate dirt, grime, and odors. A need, therefore, exists for holding the shoes during drying.

Several methods have been proposed in the art for holding shoes during drying. Grisby et al., U.S. Pat. No. 4,702,016, proposed a base to fit on the bottom of the sole of an athletic shoe and wrap about the toe and heel of the shoe. The base is held to the shoe by a pair of straps having hook and loop fasteners. Magnets in the base holds the shoe and base to a ferromagnetic surface. Although this concept was sufficient for its intended purpose, it also presented several problems. The straps, because they encircled the shoe, prevented even drying because no air flow is present under the straps. The straps also had to be tight enough to hold the shoe on the holder which collapses the upper portion of the shoe down upon the insole preventing airflow within the shoe. The straps are not attached to the base and, therefore, could be misplaced or lost destroying the functionality of the apparatus. The base is larger than the sole of the shoe requiring a different size holder for each size shoe. The base, because of its size, presents a storage problem in its own right.

Wilson, U.S. Pat. No. 4,813,641, overcomes some of these problems by providing a suction cup for attachment. A single cord wraps through the suction cup about the shoe. This allows greater airflow about the shoe but the attachment to the shoe being only one cord does not provide as great a degree of support for the shoe. Suction cups also are not as reliable as an attachment device.

A need, therefore, exists for an improved holder for athletic shoes which provides reliable support for storage and drying without inhibiting airflow.

SUMMARY OF THE INVENTION

An object of the invention is to provide a holder for shoes which may be quickly and easily connected and disconnected from the shoe.

Another object of the invention is to provide a holder for shoes which allows maximum airflow around and through the shoe.

Still another object of the invention is to provide a holder for shoes which can be used with any size shoe.

Yet another object of the invention is to provide a holder for shoes which is heat resistant, corrosion resistant, and which will not deform or injure the shoes.

A holder for a shoe includes a first member and a second member slidable into the first member. The first member has a first base and a first side attached to the first base. The first side has a curvilinear shape that partially overlap the base and projects toward the second member. The second member has a second base and a second side attached to the second base. The second side has a curvilinear shape partially overlapping the second base and projecting toward the first member. The second side also has a release handle projecting above and attached to the second side.

The second member has a latching tab projecting from the second base and inserted into the first base. The first base has a plurality of sawtooth shaped projections for engaging the latching tab of the second member.

The second member is extended away from the first member and the first and second bases are placed against the sole of a shoe. The second member is compressed toward the first member such that the first side contacts a side of the shoe while the second side contacts an opposite side of the shoe. The latching tab engages one of the projections to restrain the holder against the shoe. The base of the first member has magnets located therein to attach the first member, the second member, and the shoe to any ferromagnetic surface.

Forcing the release lever toward the shoe rotates the latching tab out of engagement with the projections thus releasing the shoe from the holder.

Other objects and advantages of the present invention will be apparent from the following description of a preferred embodiment thereof and from the attached drawings.

DETAILED DESCRIPTION OF THE INVENTION

Figure 1:
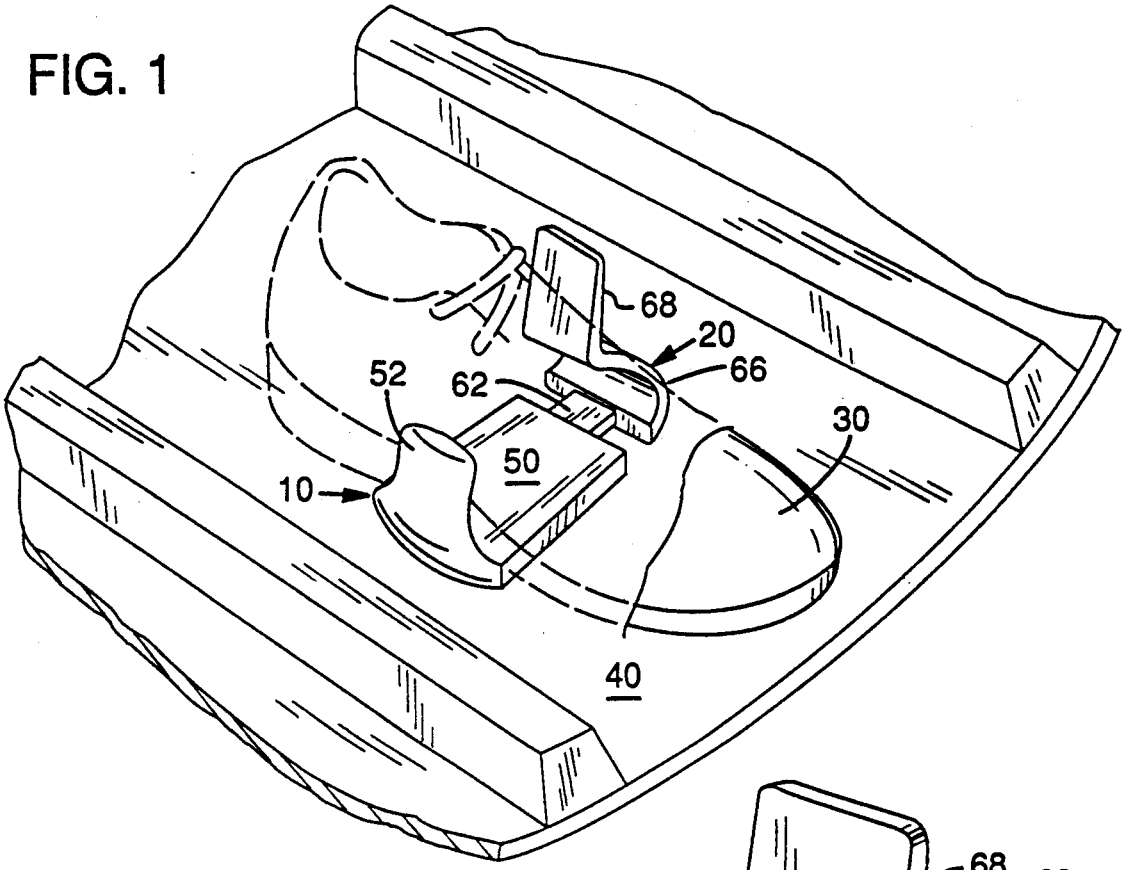
FIG. 1 is a perspective view of the holder of the present invention placed about a shoe and mounted on a ferromagnetic surface.

Referring now to FIG. 1, a holder having a first member 10 and a second member 20 slidably engagable into first member 10 holds a shoe 30 on a ferromagnetic surface 40.

Figure 2:
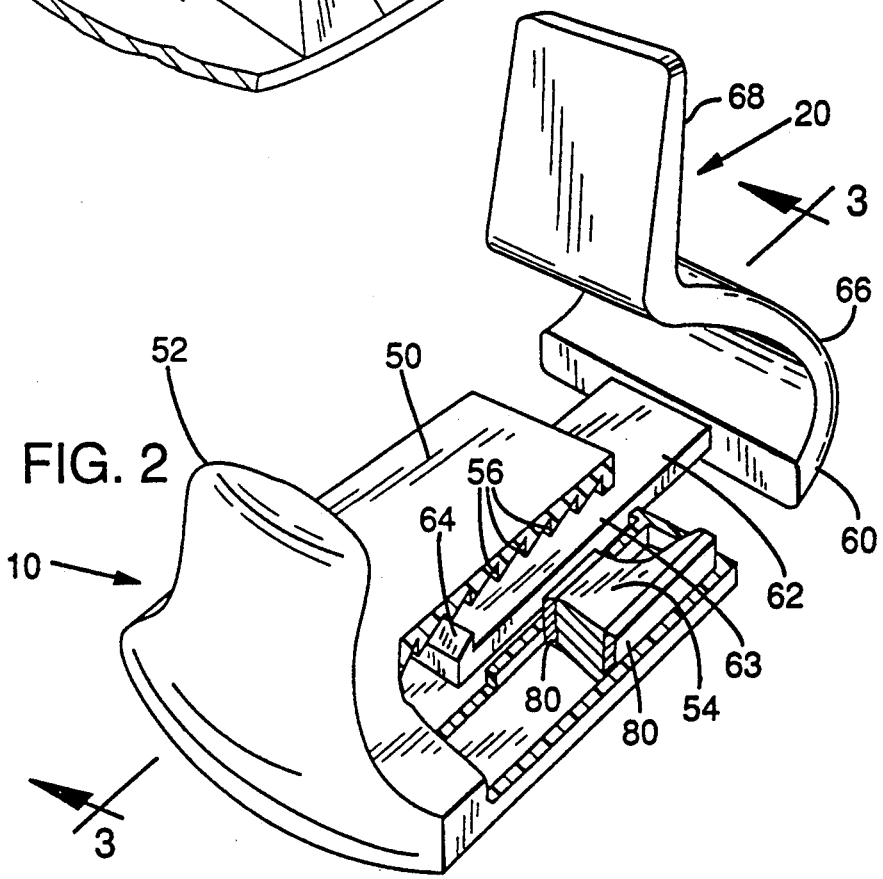
FIG. 2 is a partially broken away perspective view of the holder of the present invention.

As shown in FIG. 2, the first member 10 has a base 50 and a clamp arm or side portion 52 connected to the base 50. The base 50 has recesses for accepting securing means or magnets 54. The base also has a series of saw tooth shaped projections 56 molded therein.

Figure 3:
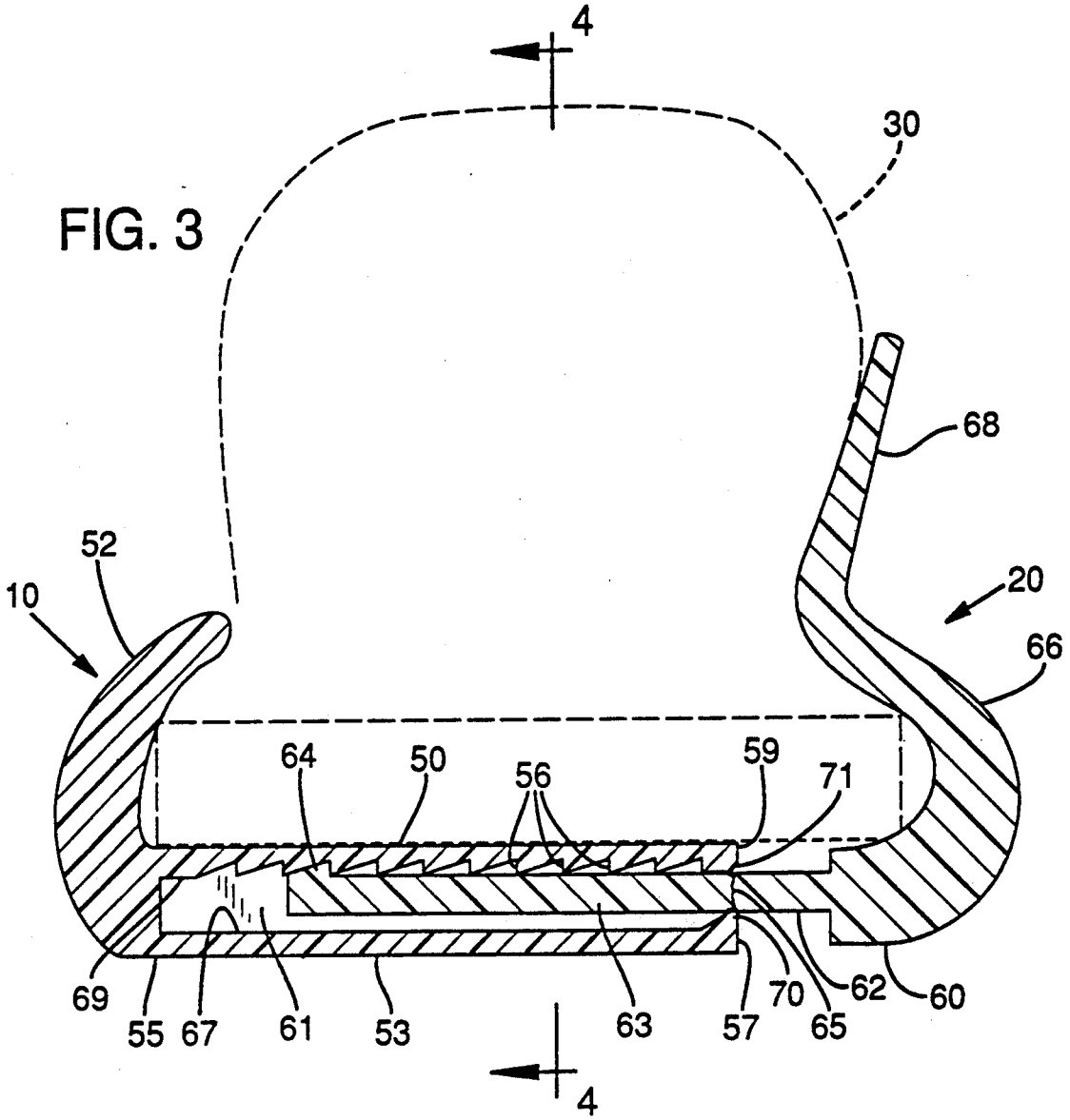
FIG. 3 is a cross sectional view of the holder of the present invention taken along lines 3—3 of FIG. 2.

As shown in FIG. 3, the first member base portion 50 has a top surface 51 and a bottom surface 53, the top surface being generally flat. The base portion has a first end 55 and a second end 57, the second end having an end surface 59 generally perpendicular to the length of the base portion. The base portion has an elongated cavity 61 therein extending inwardly from an aperture 65 on said base second end. The cavity has a planar lower surface 67 and an upper surface 69 provided with a plurality of saw tooth elements 56, the lower edges of which lie on a plane parallel to and spaced a predetermined distance from said lower surface. Each element has a length generally equal to the width of the cavity. The aperture is defined in part by a lower lip or pivot point 70 extending upwardly with respect to the lower surface of said cavity and by an upper lip 71 the edge of which lies in said plane.

The second member 20 has a base 60 with a tongue 62 projecting therefrom which slides into the first member 10. The tongue 62 has a shank 63 having parallel top and bottom surfaces, the tongue having a latching tab 64 molded on the distal end opposite the base 60. Also connected to the base 60 is a vertical curvilinear projection or side member 66. A release handle 68 is attached to the side 66.

In a preferred embodiment of the invention, the first member 10 and the second member 20 are molded from a heat resistant corrosion resistant thermoplastic material.

Referring now to FIG. 3, it can be seen that the first side 52 is a curvilinear member projecting toward the second member 20. Similarly, the second side 66 of the second member 20 is also a curvilinear surface which projects toward the first member 10. The release lever 68 attached to the second side 66 projects upwardly away from the first member 10.

As can be seen in FIG. 3, a latching mechanism or interengagement means is provided when the latching tab 64 engages the engagement members 56. As the surface 66 is forced toward the surface 52, the tongue 62 of the second member 20 is forced toward the first member 10 thereby sequentially engaging successive engagement members 56. It may also be seen from FIG. 3 that if a force is applied against the outside of release lever 68, this would, of course, cause the tongue 62 to pivot about the pivot point 70 bringing the latching tab 64 out of engagement with engagement members 56. This causes the second member 20 to be forced away from the first member 10 by the reaction force of the shoe 30.

Figure 4:
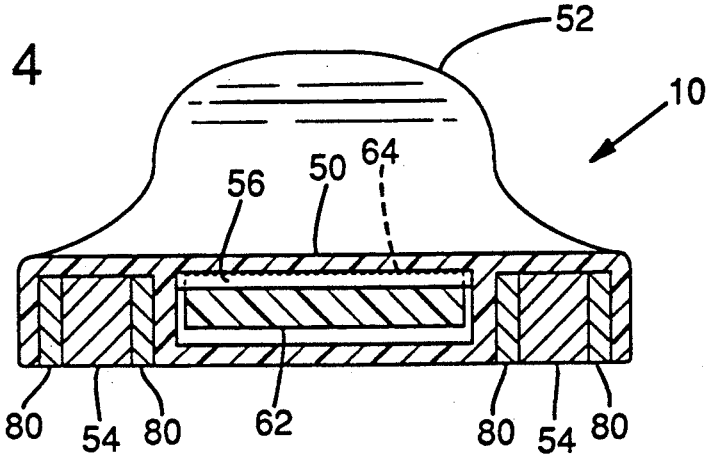
FIG. 4 is a sectional view of the holder of the present invention taken along lines 4—4 of FIG. 3.

Referring now to FIG. 4, it can be seen that magnets 54 are held in suitable cavities formed in the first member 10 by holding members 80. Adhesive, wedges, or any other suitable attachment means may be used as holding members 80 to hold the magnets in place in the base 10.

The holder of the present invention is especially useful in holding athletic shoes for drying. The shoe and holder may be placed in a conventional clothes dryer or in front of the dryer exhaust vent. The shoe and holder may also be attached to metal railings or gates.

A steel plate may be attached to any surface and the shoe and holder attached to that steel plate in any relative position. This would be especially beneficial in retail stores for displaying new shoes.

Of course, it should be understood that a wide range of changes and modifications can be made to the preferred embodiments described above. It is, therefore, intended that the foregoing descriptions be regarded illustrative rather than limiting, and that it is understood that it is the following claims, including all equivalents, which are intended to define the scope of the invention.

I claim:

1. A holder for removably securing a shoe to a ferromagnetic surface comprising:

a first member molded of thermoplastic having an elongated base portion with a top and bottom surface, the top surface being generally flat, said base portion having a first end and a second end, the second end having an end surface generally perpendicular to the length of the base portion, said base portion having an elongated cavity therein extending inwardly from an aperture on said base second end, said cavity having a planar lower surface and an upper surface provided with a plurality of saw tooth elements the lower edges of which lie on a plane parallel to and spaced a predetermined distance from said lower surface, each element having a length generally equal to the width of the cavity, said aperture being defined in part by a lower lip extending upwardly with respect to the lower surface of said cavity and an upper lip the edge of which lies in said plane, said base portion having a plurality of magnets recessed into the bottom surface thereof, said first member also having an integral vertical curvilinear side portion projecting generally upwardly and over said base portion from the first end of the base toward the second end of the base;

a second member molded of thermoplastic comprising an elongated tongue comprising a shank portion of predetermined thickness, the shank having a distal end, a base end, and upper and lower parallel surfaces spaced apart a distance substantially equal to the spacing between said upper and lower lips, said tongue being slidably received in the cavity of the first member, the tongue having a latching tab projecting upwardly from said upper surface of said shank at the distal end thereof, the combined height of said tab and said shank being less than said predetermined distance, the tab being adapted to engage any of said saw tooth elements of the first member whereby to secure said tongue from sliding movement toward said aperture, the second member having an integral vertical curvilinear projection extending upwardly from said tongue base end, said projection being curved inwardly over the tongue and toward the distal end of the tongue, the projection having an upper end with a release handle integrally attached thereto and extending generally vertically therefrom;

whereby a shoe may be locked in said apparatus by placing a shoe with its mid-section between the side portion of the first member and the projection of the second member and manually pressing the tongue of the second member into the cavity of the first member so that said side portion and said projection engage the sides of the shoe, biasing the shoe downwardly against the flat surface of the base and biasing the distal end of said elongated tongue upwardly to engage the latching tabs with a saw tooth element within the elongated cavity to lock the first member in position relative to the second member, said first member being releasable by pressing the release handle toward the first member so that said tongue pivots on said lower lip to disengage said tab from said saw tooth elements to permit said second ember to be moved with respect to said first member to release a shoe held by said members.

2. A holder for a shoe comprising:

a first member having an elongate base portion having an upper surface and a lower surface and a first curvilinear portion extending from one end of said base portion back over said base portion upper surface in spaced relation thereto to permit the toe portion of a shoe to be positioned between said base portion and said curvilinear portion, said base portion having an elongate cavity therein extending inwardly from an aperture at the end of said base portion opposite said one end, the surface of said cavity adjacent said base portion upper surface having a plurality of saw tooth elements therealong, a second member comprising an elongate tongue portion slidably received within said cavity and a second curvilinear portion extending back over said base portion in spaced relation thereto, said tongue portion having a latching tab projecting from the inner end thereof toward said saw tooth elements and adapted to engage one of said saw tooth elements to prevent withdrawal of said tongue from said cavity, said cavity having a lower surface spaced from said saw tooth elements by a distance greater than the combined height of said tongue and locking tab, and a pivot lip projecting upwardly from said cavity lower surface at the aperture thereof a predetermined distance sufficient to engage the lower surface of said tongue portion to cause said latching tab to engage a saw tooth element when said curvilinear portions are in engagement with a shoe positioned in said holder, said locking tab being releasable from engagement with said saw tooth elements by manually moving the upper ends of said curvilinear portions toward one another to effect pivoting of said tongue on said pivot lip and disengagement of said latching tab and said sawtooth elements whereby said tongue may be moved outwardly with respect to said cavity to release a shoe engaged in said holder, and securing means on said base portion for securing the same to a supporting element.

3. A holder as set forth in claim 2 wherein said securing means comprises a magnet.

4. A holder for a shoe comprising:

a first member having an elongate base portion and a first curvilinear portion extending from one end of said base portion back over said base portion in spaced relation thereto to engage one side of a shoe positioned between said base portion and said curvilinear portion, said base portion having an elongate cavity therein extending inwardly from an aperture at the end of said base portion opposite said one end.

a second member comprising an elongate tongue portion slidably received within said cavity and a second curvilinear portion extending back over said base portion in spaced relation thereto for engaging the opposite side of a shoe positioned on said base portion, said cavity having a lower surface and a pivot lip projecting upwardly a predetermined distance from said cavity lower surface at the said aperture thereof, interengaging means on the inner end of said tongue and the upper surface of said cavity adapted to engage and restrain said tongue from movement outwardly of said cavity when a shoe is engaged by said curvilinear portions and said tongue is substantially parallel to said first member base portion, said interengaging means being adapted to disengage upon movement of the upper ends of said curvilinear portions toward one another to effect pivoting of said tongue on said pivot lip whereby to permit said tongue to be moved outwardly with respect to said cavity.

and securing means on said base portion for securing the same to a supporting element.

5. A holder as set forth in claim 4 wherein said securing means comprises a magnet.

* * * * *

UNITED STATES PATENT AND TRADEMARK OFFICE

CERTIFICATE OF CORRECTION

PATENT NO. : 5,024,408

DATED : June 18, 1991

INVENTOR(S) : Maynard Magee

It is certified that error appears in the above-identified patent and that said Letters Patent is hereby corrected as shown below:

Title page under Attorney, Agent or Firm, "Karlquist" should be --Klarquist--.

Column 1, line 28, "holds" should be --hold--.

Column 2, line 13, "overlap" should be --overlaps--.

Column 4, line 66, "ember" should be --member--.

Column 5, line 39, "sawtooth" should be --saw tooth--.

Column 6, line 36, "cavity." should be --cavity,--.

Signed and Sealed this

Sixteenth Day of March, 1993

*Attest:*

STEPHEN G. KUNIN

*Attesting Officer*

*Acting Commissioner of Patents and Trademarks*